United States Patent [19]

Stephens

[11] 4,025,243

[45] May 24, 1977

[54] ORBITAL DEVICE

[75] Inventor: William T. Stephens, New Brighton, Minn.

[73] Assignee: Gresen Manufacturing Company, Minneapolis, Minn.

[22] Filed: Jan. 5, 1973

[21] Appl. No.: 321,237

[52] U.S. Cl. ..... 418/61 B

[51] Int. Cl.[2] ..... F03C 3/00; F04C 1/02

[58] Field of Search ..... 418/61 R, 61 B, 171

[56] References Cited

UNITED STATES PATENTS

| | | | |
|---|---|---|---|
| 2,871,831 | 3/1959 | Patin | 418/61 B |
| 3,288,034 | 11/1966 | White, Jr. et al. | 418/61 B |
| 3,431,863 | 3/1969 | Waldorff | 418/61 B |
| 3,490,383 | 1/1970 | Parrett | 418/61 B |

FOREIGN PATENTS OR APPLICATIONS

| | | | |
|---|---|---|---|
| 589,419 | 3/1934 | Germany | 418/61 R |
| 590,003 | 3/1934 | Germany | 418/61 R |

*Primary Examiner*—Carlton R. Croyle
*Assistant Examiner*—Leonard Smith
*Attorney, Agent, or Firm*—Merchant, Gould, Smith, Edell, Welter & Schmidt

[57] ABSTRACT

An orbital device in which the effective roots of the internally extending teeth on an orbital member is equal to the radial dimension of the fluid ports. This is achieved by providing grooves in the surfaces of the orbital member adjacent the roots of the teeth. The shape of the ports is complimentary to that of the internal teeth on the orbital member.

8 Claims, 7 Drawing Figures

ORBITAL DEVICE

BACKGROUND OF THE INVENTION

The prior art with which my invention is concerned is exemplified in U.S. Pat. Nos. 2,871,831, issued Feb. 3, 1959, to one P. C. Patin, for INTERNAL GEAR MACHINES; 3,391,608 issued July 9, 1968, to M. J. Huber, for HYDRAULIC TORQUE MOTOR; and U.S. Pat. No. 3,490,383, issued Jan. 20, 1970, to J. T. Parrett for HYDRAULIC PUMP OR MOTOR.

Each of these patents deals with various and sundry aspects of orbital type devices which may be used as hydraulic pumps or motors. The Patin patent, for example, illustrates a form of characterized or specially configured porting for use with an orbiting inner member of a gerotor set and illustrates ports of a triangular shape which are defined by circular arcs that are related to the shape of the teeth on the inner externally toothed, orbiting member. The Huber patent refers to recessed portions adjacent the roots of the internal teeth on an outer member of a gerotor set which is designed to orbit about an externally toothed inner member. These are described as being notches to prevent trapping of fluid during relative movement of the gerotor elements. The Parrett patent illustrates a deep root tooth configuration for the outer member of a gerotor set which is also designed to move in an orbital manner with respect to the inner externally toothed member of the gerotor set. The purpose of the roots in the Parrett patent is to provide access or fluid communication with a number of circumferentially spaced fluid ports which are disposed a substantial radial distance from the axis of rotation of the rotary member of the gerotor set. Without the deep rooted construction, it would be impossible to place the ports in the position desired by the inventor with the general form of gerotor set construction as exemplified in the Huber and Patin patents.

SUMMARY OF THE INVENTION

Through proper proportioning of the elements which cooperate to perform the functions of an orbital device, I have provided an improved orbital device which may be used as a pump or motor and which provides a substantial improvement in efficiency in the transfer of hydraulic fluid to and from the device.

This is accomplished by relating the effective depth of the roots of an orbital outer gerotor member to the radial height of fluid ports that are opened and closed in a sequential manner by the orbital motion of the outer orbital member. This is achieved by greatly increasing the radial height of the ports and then increasing the effective root of the internally extending teeth on the outer gerotor member by providing grooves on the surfaces adjacent the roots of the teeth. Under some circumstances, the roots of the teeth may be cut completely through between the surfaces of the outer orbital member of the gerotor set. To further provide volumetric efficiency and rapid transfer of fluid, the shape of the ports and the shape of the internal gear teeth are designed to be complementary whereby very small orbital motion of the outer orbital member produces a substantially large effective port.

All this provides a very great increase in efficiency of operation while at the same time allowing a form of orbital device construction presenting a new and improved simplicity of construction whereby fluid is supplied to the expanding and contracting pockets defined between the inner and outer gerotor elements as they move relative one another from one side of the assembly and is exhausted, or removed, form the other side of the assembly to allow a more direct flow of hydraulic fluid. This is accomplished by forming the ports integrally of a pair of end members, the ports on one end member being open and closed by one surface of the outer orbiting member and the ports in the other end member being open and closed by the other surface of the outer orbital member and the shape of the ports relative to the shape of the internal teeth on the outer orbiting member being such that proper timing of the opening and closing of the respective corresponding "sets" of ports on the two end members is attained.

These and other objects of my invention will become apparent from a consideration of the appended specification, claims and drawings in which:

Figure 1:
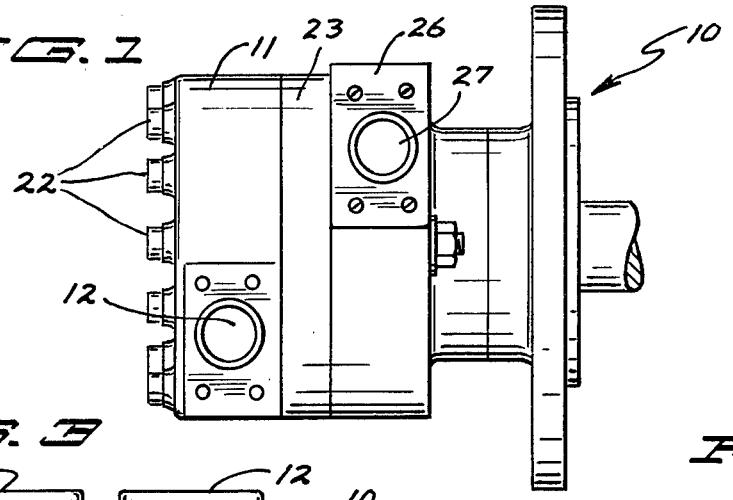
FIG. 1 is a top elevational view of an orbital device incorporating the features of my invention.
Figure 3:
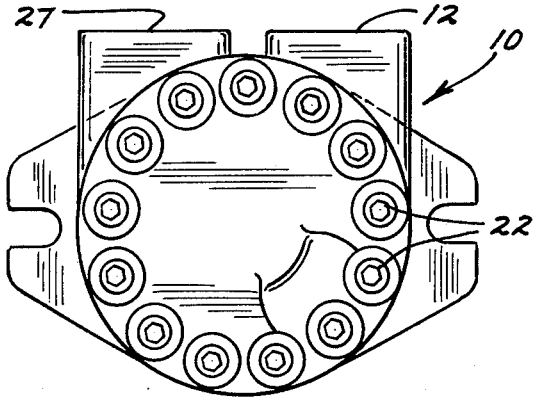
FIG. 3 is a left end view of the orbital device shown in FIG. 1 of the drawings.
Figure 2:
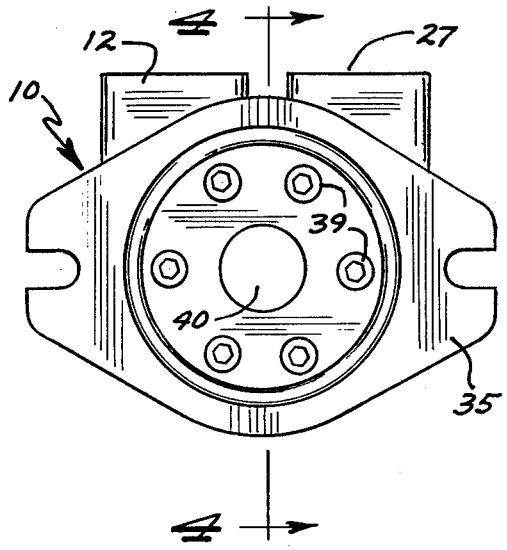
FIG. 2 is a right end view of the orbital device shown in FIG. 1 of the drawings.
Figure 4:
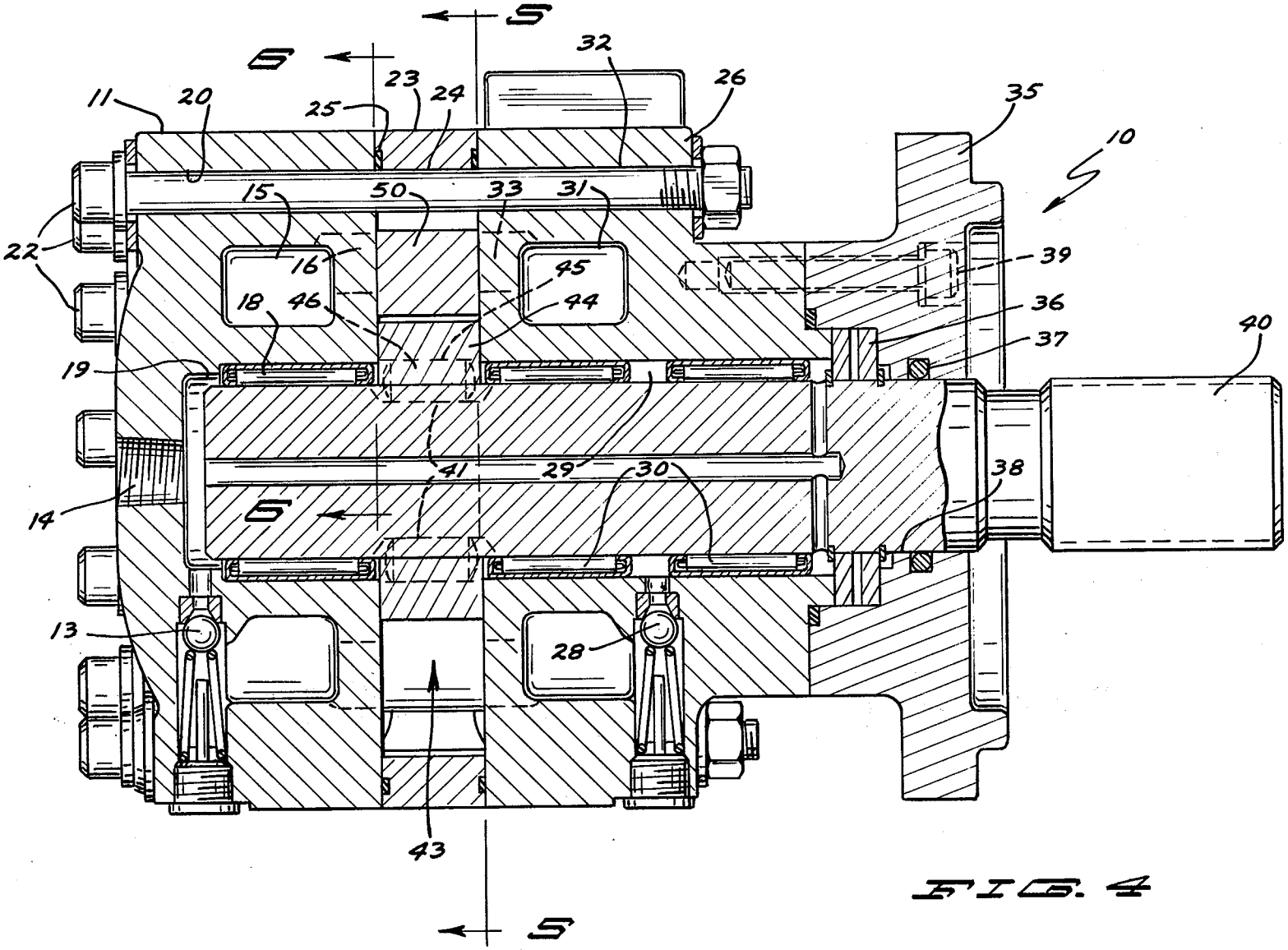
FIG. 4 is an enlarged sectional view of the orbital device shown in FIGS. 1, 2 and 3 taken along section line 4—4 on FIG. 2 of the drawings.

Referring now to the drawings, an orbital device that may be used as a motor or pump is indicated generally by reference character 10. Device 10 includes a left end portion 11 having an inlet port 12, a relief poppet 13, a plug 14, a duct 15, and a plurality of ports 16 of a dimension indicated generally on FIGS. 5 and 6 of the drawings which are connected to port 12 through duct 15, a bearing 18 disposed in a bearing aperture 19 and a plurality of circumferentially spaced apertures 20 adapted to receive a like plurality of screws or fasteners 22. A center ring 23 is shown having a generally cylindrical shape and may be provided with a like plurality of notches or apertures 24 and a pair of axially outwardly opening grooves in which suitable seals, 25, may be disposed. Seals 25 may conveniently take the form of conventional O-rings of suitable size and shape to effect the desired seal intermediate the parts defining the housing of device 10. Right end 26 includes an outlet port 27, a relief poppet 28, a center hole 29 in which suitable bearings 30 are disposed, a duct 31, a plurality of apertures 32 corresponding to the number of screw threaded fasteners 22 and a plurality of ports 33 corresponding in number to the ports 16 disposed on the left end of device 10, said ports being dimensioned to coact with the internal teeth on the outer orbital member in a manner to be described below and being of supplementary shape with respect to ports 16 on left end 11. Device 10 also includes a shaft retainer and mounting member 35 which includes a center hole 38, a pair of seals 36 and 37. A plurality of screw threaded fasteners 39 are shown extending through shaft retainer and mounting member 35 into suitably threaded and positioned receptacles in right end 26.

A shaft member is journalled in bearing members 18 and 30 and extends outwardly through shaft retainer and mounting member 35, indicated generally by reference character 40. Shaft 40 includes a pair of outwardly opening grooves 41 at a position intermediate its ends to receive a rotor to be described below.

Figure 6:
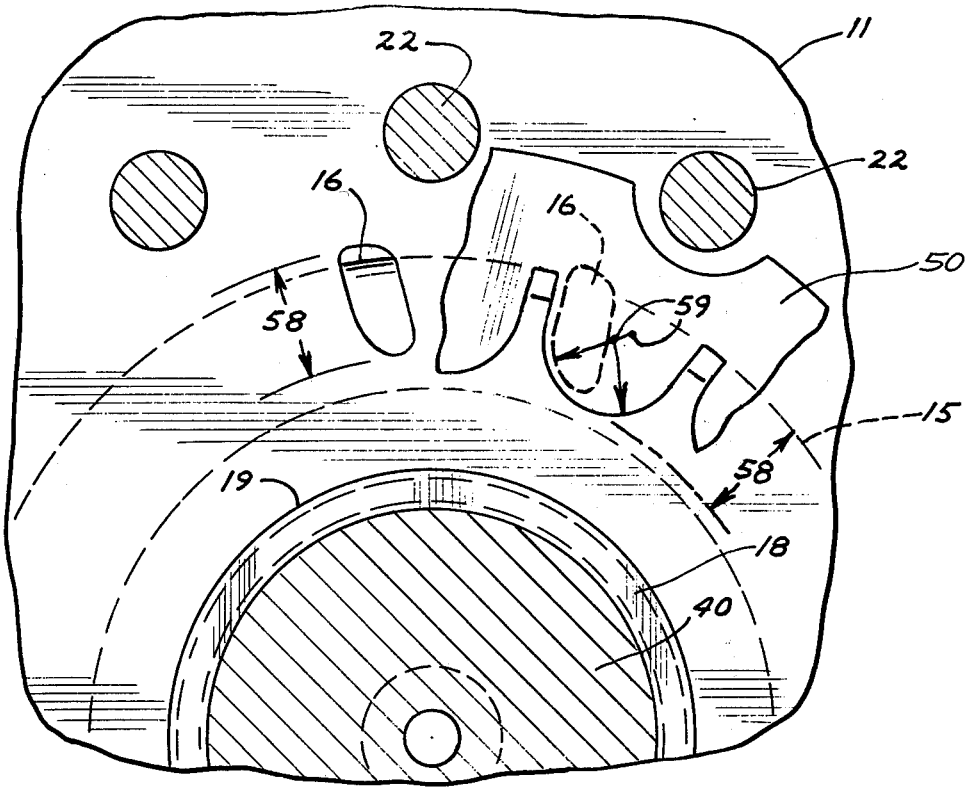
FIG. 6 is an enlarged fragmentary view of a portion of FIG. 4 taken along section line 6—6 to which a fragmentary portion of the outer orbiting element of a gerotor set has been applied.
Figure 7:
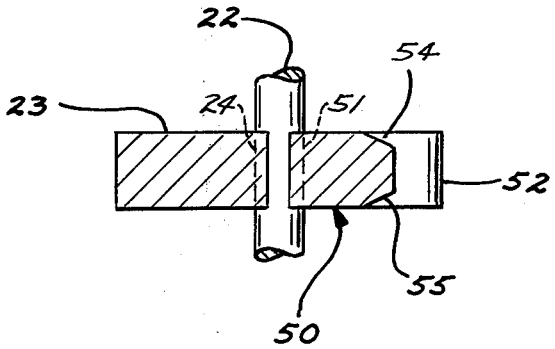
FIG. 7 is an enlarged fragmentary sectional view of my device taken along section lines 7—7 on FIG. 5 of the drawings.

My orbital device 10 also includes a gerotor set indicated generally by reference character 43 and specifically includes a rotor 44 which has a pair of inwardly opening grooves around a centrally disposed aperture to receive a pair of circular keys 46 to mount rotor 44 on shaft 40 for rotation therewith about its axis, 48. An orbital member 50 is shown disposed around rotor 44 and includes a plurality of radially outwardly opening grooves 51 corresponding in number to the number of fasteners 22 and a plurality of inwardly extending teeth, 52, the number of teeth being one greater in number then the outwardly extending teeth 47 on rotor 44. The reference numeral 53 designates the expanding and contracting chambers between the rotor 44 and orbital member 52. The teeth 52 on orbital member 50 are provided with a root configuration which provides an effective depth greater than that which would be required to adequately receive the outwardly extending teeth 47 on rotor 44. This is provided by forming a pair of outwardly opening grooves or relief portions 54 and 55 in the surfaces of orbital member 50 (FIG. 7) whereby the effective height of the internal teeth 52 on orbital member 50, indicated generally by reference character 58, in FIG. 6, is equal to the radial height of ports 16 and 33, also indicated by reference character 58 (see FIG. 6 of the drawing). The configuration of ports 16 on FIG. 6 of the drawing may be seen to include a radius at one edge indicated generally by reference character 59 that is the same as the radius of the internal tooth 52 on orbital member 50, also indicated generally by reference character 59.

Figure 5:
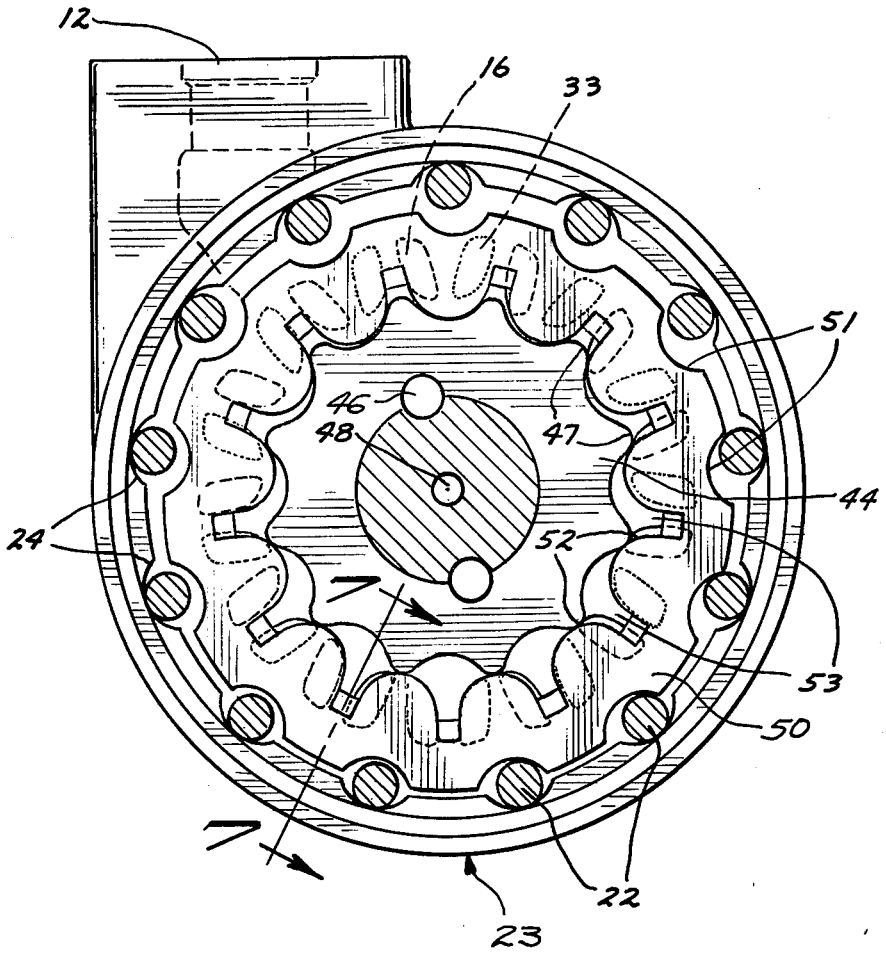
FIG. 5 is an enlarged sectional view of the device shown in FIGS. 1, 2 and 3 taken along section line 5—5 of FIG. 4 of the drawings with several of the elements shown in dotted outline indicating the relationship thereof with those illustrated in FIG. 5.

It may be seen from a consideration of FIG. 5 of the drawings that the opening and closing of ports 16 and 33 is accomplished in such a manner as to provide for an increased and improved flow of fluid due to the coaction between the shape of the ports and the effective shape of the internal teeth on the outer orbital member as it orbits about its axis as allowed by the engagement of the radial outwardly facing grooves 51 with the surfaces of screw threaded fasteners 22 extending through the chamber defined by right and left ends 26 and 11 and center ring 23, respectively.

Having now therefore fully illustrated and described my invention, what I claim to be new and desire to protect by Letters Patent is:

1. In apparatus of the class above described including a chambered housing, an externally toothed rotor mounted on a shaft for rotation within the chamber, an internally toothed orbital member in the chamber and adapted to move in an orbital fashion about said rotor to form expanding and contracting pockets as said rotor rotates and said orbital member orbits, said orbital member having a greater number of teeth than said rotor, the combination comprising; a plurality of circumferentially spaced apart inlet and outlet ports disposed in the housing radially outwardly of the rotor, the number of inlet ports being equal to the number of teeth on said orbital member and the number of outlet ports being equal to the number of teeth on said orbital member, said ports abutting the orbital member, said ports being radially elongated equal to the effective height of the teeth on said orbital member, each of said ports including a side portion complementary to the configuration of the side of the teeth on the orbital member, and duct means connecting alternate ports to an inlet duct and the others of said ports to an outlet duct.

2. The apparatus of claim 1 in which alternate ports are of supplementary shape to one another.

3. The apparatus of claim 1 in which alternate ports are disposed on opposite sides of the orbital member.

4. The apparatus of claim 1 in which the height of the ports is equal to or greater than the root depth of the internal teeth on the orbital member plus the length of a groove extending radially outward from the root of the teeth.

5. The apparatus of claim 1 in which the height of the ports is equal to or greater than the root depth of the internal teeth of the orbital member plus the height of a radial groove centered in the root of the teeth.

6. In apparatus of the class above described including a chambered housing, an externally toothed rotor mounted on a shaft for rotation within the chamber, an internally toothed orbital member in the chamber and adapted to move in an orbital fashion about said rotor to form expanding and contracting pockets as said rotor rotates and said orbital member orbits, said orbital member having a greater number of teeth than said rotor, the combination comprising; a plurality of circumferentially spaced apart inlet and outlet ports disposed in the housing radially outwardly of the rotor, the number of inlet ports being equal to the number of teeth on said orbital member and the number of outlet ports being equal to the number of teeth on said orbital member, said ports abutting the orbital member and said ports being radially elongated equal to the effective height of the teeth on said orbital member, and the root depth of the internal teeth on the orbital member is less than the radial height of the ports and a groove extends radially outwardly from the root of said teeth, and duct means connecting alternate ports to an inlet duct and the others of said ports to an outlet duct.

7. The apparatus of claim 6 in which alternate ports are of supplementary shape to one another.

8. The apparatus of claim 6 in which alternate ports are disposed on opposite sides of the orbital member.

* * * * *